US008383566B2

(12) United States Patent
Zhu

(10) Patent No.: US 8,383,566 B2
(45) Date of Patent: Feb. 26, 2013

(54) HIGHLY ACIDIC HARD SURFACE TREATMENT COMPOSITIONS FEATURING GOOD GREASY SOIL AND SOAP SCUM REMOVAL

(75) Inventor: Yun-Peng Zhu, Fairlawn, NJ (US)

(73) Assignee: Reckitt Benckiser LLC, Parsippany, NJ (US)

( * ) Notice: Subject to any disclaimer, the term of this patent is extended or adjusted under 35 U.S.C. 154(b) by 184 days.

(21) Appl. No.: 13/085,015

(22) Filed: Apr. 12, 2011

(65) Prior Publication Data

US 2011/0277786 A1 Nov. 17, 2011

(30) Foreign Application Priority Data

Apr. 15, 2010 (GB) ..... 1006241.2

(51) Int. Cl.
*C11D 3/20* (2006.01)

(52) U.S. Cl. ..... 510/238; 510/362; 510/426; 510/477; 510/488; 510/505; 510/506

(58) Field of Classification Search ..... 510/238, 510/362, 426, 477, 488, 505, 506
See application file for complete search history.

(56) References Cited

FOREIGN PATENT DOCUMENTS

| | | | |
|---|---|---|---|
| WO | 2007/104921 | A1 | 9/2007 |
| WO | 2008/068463 | A1 | 6/2008 |
| WO | 2009/060171 | A1 | 5/2009 |

OTHER PUBLICATIONS

GB Combined Search and Examination Report issued Sep. 29, 2010, in GB Application No. GB1006241.2.

*Primary Examiner* — Gregory Webb
(74) *Attorney, Agent, or Firm* — Norris McLaughlin & Marcus PA

(57) ABSTRACT

Disclosed are aqueous, acidic hard surface cleaning compositions particularly effective in the removal of greasy stains and soapscum from hard surfaces. The compositions have a pH of not more than 2, preferably not more than 1, comprising: one or more anionic surfactants; a nonioinic surfactant constituent which preferably comprises both a first alcohol ethoxylate nonionic surfactant derived from monobranched alkoxylated $C_{10}$-fatty alcohols and/or $C_{11}$-fatty alcohols and about a second alcohol ethoxylate nonionic surfactant, preferably a $C_{10}$-$C_{14}$ linear alcohol ethoxylated surfactant having at least about 8 mols ethoxylation, an organic solvent constituent, which preferably comprises or consists of a phenyl containing glycol ether solvent, an acid constituent, which most preferably comprises, or consists of, a ternary acid system comprising each of: sulfamic acid, formic acid and oxalic acid in a respective weight ratio of sulfamic acid:formic acid: oxalic acid of 1-8:1-5:1-3. Methods for providing a cleaning treatment of hard surfaces utilizing the said compositions are also disclosed.

8 Claims, No Drawings

HIGHLY ACIDIC HARD SURFACE TREATMENT COMPOSITIONS FEATURING GOOD GREASY SOIL AND SOAP SCUM REMOVAL

The present invention relates to improved hard surface cleaning compositions. More particularly the present invention is directed to aqueous acidic hard surface cleaning compositions featuring good cleaning efficacy of soap scum stains and greasy soils.

Hard surface cleaning compositions are commercially important products and enjoy a wide field of use, and are known in assisting in the removal of dirt and grime from surfaces, especially those characterized as useful for cleaning "hard surfaces". Hard surfaces include those which are frequently encountered in lavatories, e.g., lavatory fixtures such as toilets, shower stalls, bathtubs, bidets, sinks, etc. Hard surfaces are also frequently encountered in kitchens and other food preparation areas as well, e.g., kitchen countertops, food preparation surfaces, tables, sinks, as well as kitchen machinery and appliances. In such kitchen and lavatory environments two types of commonly encountered stains are "greasy stains" as well as "soap scum" stains. Greasy stains are typically residues of hydrophobic materials such as fats, oils, sebum and the like which form undesirable unsightly residues on such surfaces. Soap scum stains are residues of fatty acid soaps, such as soaps which are based on alkaline salts of low fatty acids. These fatty acids are known to precipitate in hard water due to the presence of metal salts therein leaving an undesirable residue upon such surfaces.

Although the prior art provides a variety of compositions which provide effective cleaning of one or more of the foregoing classes of stains, there is still an urgent need in the art to provide improved hard surface cleaning compositions which are effective in the treatment of many types of stains typically encountered on hard surfaces, particularly in a home or commercial environment, especially in or around kitchens and lavatories where cleanliness is of special importance. It is to such needs that the compositions of the present invention are particularly directed.

Broadly stated, the compositions of the present invention are directed to aqueous acidic hard surface cleaning compositions featuring good cleaning efficacy of soap scum stains and greasy soils.

In a further aspect the present invention also provides methods for the production of such hard surface cleaning compositions, as well as methods for their use.

The acidic hard surface cleaning compositions of the present invention comprises:

about 0.05-1% wt. of one or more anionic surfactants;

about 0.05-7.5% wt. of a nonionic surfactant constituent which said constituent preferably comprises both about 0.5-2.5% wt. of a first alcohol ethoxylate nonionic surfactant derived from monobranched alkoxylated $C_{10}$-fatty alcohols and/or $C_{11}$-fatty alcohols and about 0.05-0.5% wt. of a second alcohol ethoxylate nonionic surfactant, preferably a $C_{10}$-$C_{14}$ linear alcohol ethoxylated surfactant having at least about 8 mols ethoxylation;

about 0-5% wt. of one or more further surfactants which may include amphoteric or zwitterionic surfactants, but which expressly exclude cationic surfactants;

about 0.01-5% wt. of an organic solvent constituent, which preferably comprises or consists of a phenyl containing glycol ether solvent;

about 0-5% wt. of an alkanolamine;

about 2-15% wt. of a an acid constituent, which most preferably comprises, or consists of a ternary acid system comprising each of: sulfamic acid, formic acid and oxalic acid in a respective weight ratio of sulfamic acid:formic acid:oxalic acid of 1-8:1-5:1-3;

optionally one or more further constituents which are directed to improving one or more aesthetic or functional features of the composition, which may be present in a cumulative amount of not in excess of about 10% wt. of the total of the composition of which they form a part, at least 85% wt. water, preferably at least about 90% wt. water;

wherein the compositions have a pH of about 2 or less, but especially preferably have a pH not in excess of 1, and further wherein the compositions exhibit good removal of greasy stains and concurrently also exhibit good soapscum removal from hard surfaces.

The compositions of the present invention exhibit good cleaning properties against stains commonly found in household, commercial and residential settings, particularly in kitchen settings wherein greasy soils and stains are frequently encountered. The preferred compositions of the invention are particularly effective in the cleaning of greasy stains, as well as soap scum from hard surfaces. This result is surprising when considering the highly acidic pH of the compositions, which would normally be considered effective in the removal of limescale deposits, but expected poor performance in the removal of greasy stains.

In this specification, by the term "expressly excluded" is to be understood that less than 0.05% wt. of an identified constituent(s) is present in the inventive compositions, but preferably, such identified constituent(s) are absent or otherwise excluded from the inventive compositions, viz. include 0% wt. of the identified constituent(s).

The inventive compositions necessarily include an anionic surfactant constituent.

Generally any anionic surfactant material may be used in the inventive compositions as a detersive surfactant. By way of non-limiting example, suitable anionic surfactants include: alkali metal salts, ammonium salts, amine salts, or aminoalcohol salts of one or more of the following compounds (linear and secondary): alcohol sulfates and sulfonates, alcohol phosphates and phosphonates, alkyl sulfates, alkyl ether sulfates, sulfate esters of an alkylphenoxy polyoxyethylene ethanol, alkyl monoglyceride sulfates, alkyl sulfonates, olefin sulfonates, paraffin sulfonates, beta-alkoxy alkane sulfonates, alkylamidoether sulfates, alkylaryl polyether sulfates, monoglyceride sulfates, alkyl ether sulfonates, ethoxylated alkyl sulfonates, alkylaryl sulfonates, alkyl benzene sulfonates, alkylamide sulfonates, alkyl monoglyceride sulfonates, alkyl carboxylates, alkyl sulfoacetates, alkyl ether carboxylates, alkyl alkoxy carboxylates having 1 to 5 moles of ethylene oxide, alkyl sulfosuccinates, alkyl ether sulfosuccinates, alkylamide sulfosuccinates, alkyl sulfosuccinamates, octoxynol or nonoxynol phosphates, alkyl phosphates, alkyl ether phosphates, taurates, N-acyl taurates, fatty taurides, fatty acid amide polyoxyethylene sulfates, isethionates, acyl isethionates, and sarcosinates, acyl sarcosinates, or mixtures thereof. Generally, the alkyl or acyl radical in these various compounds comprise a carbon chain containing 12 to 20 carbon atoms. The anionic surfactants may be provided in their free acid form as may be appropriate to the particular compound, or may be supplied in salt form with water soluble counterion or cation, e.g. alkali metal salts, ammonium salts, amine salts, or aminoalcohol salts as outlined above.

Preferred as anionic surfactants are one or more anionic surfactants of the sulfate and/or sulfonate type, and especially wherein such are provided in their free acid form. One particularly preferred anionic surfactant is an alkylbenzene sulfonic acid.

The one or more anionic surfactants may be included in amounts of from about 0.05%-1% by weight, more desirably from about 0.01%-0.5% by weight. based on the total weight of the compositions of which they form a part.

The inventive compositions necessarily include a nonionic surfactant constituent which comprises at least one nonionic surfactant.

Exemplary useful nonionic surfactants based on condensation products of aliphatic alcohols with alkylene oxides include the condensation products of aliphatic alcohols with from about 1 to about 60 moles of an alkylene oxide, especially an ethylene oxide. The alkyl chain of the aliphatic alcohol can either be straight or branched, primary or secondary, and generally contains from about 8 to about 22 carbon atoms. Useful as detersive nonionic surfactants based on alcohol alkoxylates are a variety of nonionic surfactants known to the art. Such include, nonionic surfactants produced as the condensation products of aliphatic alcohols with from about 1 to about 60 moles of an alkylene oxide, especially an ethylene oxide. The alkyl chain of the aliphatic alcohol can either be straight or branched, primary or secondary, and generally contains from about 8 to about 22 carbon atoms. Examples of such ethoxylated alcohols include the condensation product of myristyl alcohol condensed with about 10 moles of ethylene oxide per mole of alcohol and the condensation product of about 9 moles of ethylene oxide with coconut alcohol (a mixture of fatty alcohols with alkyl chains varying in length from about 10 to 18 carbon atoms). Other examples are those $C_6$-$C_{18}$ straight-chain alcohols which are ethoxylated with from about 3 to about 6 moles of ethylene oxide. Their derivation is well known in the art. Examples include Alfonic® 810-4.5, which is described in product literature from Sasol as a C8-10 having an average molecular weight of 356, an ethylene oxide content of about 4.85 moles (about 60 wt. %), and an HLB of about 12; Alfonic® 810-2, which is described in product literature as a C8-10 having an average molecular weight of 242, an ethylene oxide content of about 2.1 moles (about 40 wt. %), and an HLB of about 12; and Alfonic® 610-3.5, which is described in product literature as having an average molecular weight of 276, an ethylene oxide content of about 3.1 moles (about 50 wt. %), and an HLB of 10. Other examples of alcohol ethoxylates are C10 oxo-alcohol ethoxylates available from BASF under the Lutensol® ON tradename. They are available in grades containing from about 3 to about 11 moles of ethylene oxide (available under the names Lutensol® ON 30; Lutensol® ON 50; Lutensol® ON 60; Lutensol® ON 65; Lutensol® ON 66; Lutensol® ON 70; Lutensol® ON 80; and Lutensol®ON 110). Other examples of ethoxylated alcohols include the Neodol® series non-ionic surfactants available from Shell Chemical Company which are described as $C_9$-$C_{11}$ ethoxylated alcohols. The Neodol® 91 series non-ionic surfactants of interest include Neodol® 91-2.5, Neodol® 91-6, and Neodol® 91-8. Neodol® 91-2.5 has been described as having about 2.5 ethoxy groups per molecule; Neodol 91-6 has been described as having about 6 ethoxy groups per molecule; and Neodol 91-8 has been described as having about 8 ethoxy groups per molecule. Further members of the Neodol® series including those of the Neodol® 25 series as well as the Neodol® 45 series are of particular interest, and include, inter alia, Neodol® 25-9 described as $C_{12}$-$C_{15}$ ethoxylated alcohols with about 9 ethoxy groups per molecule and Neodol® 45-7 described as $C_{14}$-$C_{15}$ ethoxylated alcohols with about 7 ethoxy groups per molecule. Other members of the Neodol® series of ethoxylated alcohols are also considered to be particularly suitable for use in the compositions of the present invention and are in certain instances, examples of preferred nonionic surfactants. Further examples of ethoxylated alcohols include the Rhodasurf® DA series non-ionic surfactants available from Rhodia which are described to be branched isodecyl alcohol ethoxylates. Rhodasurf® DA-530 has been described as having 4 moles of ethoxylation and an HLB of 10.5; Rhodasurf® DA-630 has been described as having 6 moles of ethoxylation with an HLB of 12.5; and Rhodasurf® DA-639 is a 90% solution of DA-630. Further examples of ethoxylated alcohols include those from Tomah Products (Milton, Wis.) under the Tomadol® tradename with the formula $RO(CH_2CH_2O)_nH$ where R is the primary linear alcohol and n is the total number of moles of ethylene oxide. The ethoxylated alcohol series from Tomah include 91-2.5; 91-6; 91-8—where R is linear $C_9/C_{10}/C_{11}$ and n is 2.5, 6, or 8; 1-3; 1-5; 1-7; 1-73B; 1-9; where R is linear $C_{11}$ and n is 3, 5, 7 or 9; 23-1; 23-3; 23-5; 23-6.5—where R is linear $C_{12}/C_{13}$ and n is 1, 3, 5, or 6.5; 25-3; 25-7; 25-9; 25-12—where R is linear $C_{12}/C_{13}/C_{14}/C_{15}$ and n is 3, 7, 9, or 12; and 45-7; 45-13—where R is linear $C_{14}/C_{15}$ and n is 7 or 13.

A further class of useful nonionic surfactants which find use as the alcohol alkoxylate include primary and secondary linear and branched alcohol ethoxylates, such as those based on $C_6$-$C_{18}$ alcohols which further include an average of from 2 to 80 moles of ethoxylation per mol of alcohol. These examples include the Genapol® UD (ex. Clariant, Charlotte, N.C.) described under the tradenames Genapol® UD 030, $C_{11}$-oxo-alcohol polyglycol ether with 3 EO; Genapol® UD, 050 $C_{11}$-oxo-alcohol polyglycol ether with 5 EO; Genapol® UD 070, $C_{11}$-oxo-alcohol polyglycol ether with 7 EO; Genapol® UD 080, $C_{11}$-oxo-alcohol polyglycol ether with 8 EO; Genapol® UD 088, $C_{11}$-oxo-alcohol polyglycol ether with 8 EO; and Genapol® UD 110, $C_{11}$-oxo-alcohol polyglycol ether with 11 EO.

Further useful as nonionic surfactant constituents are alkylpolyglycoside surfactants including alkyl monoglycosides and polyglycosides which are prepared generally by reacting a monosaccharide, or a compound hydrolyzable to a monosaccharide with an alcohol such as a fatty alcohol in an acid medium. Preferred alkylpolyglycoside surfactants include those which may be represented by formula I below:

$$RO(R'O)_x(Z)_y \quad [I]$$

wherein:

R is a monovalent organic radical containing from about 6 to about 30 carbon atoms;

R' is a divalent hydrocarbon radical containing from about 2 to about 4 carbon atoms, especially ethyl and propyl radicals;

Z is a saccharide residue having from 4 to 8, especially about 5-6 carbon atoms;

O is an oxygen atom;

x is a number which has an average value from about 0 to about 12; and, y is a number having an average value from about 1 to about 6.

By way of non-limiting examples useful alkylpolyglycosides include GLUCOPON® 225, described to be an alkylpolyglycoside in which the alkyl group contains 8 to 10 carbon atoms; APG® 325 and APG® 300, each described to be an alkyl polyglycoside in which the alkyl group contains 9 to 11 carbon atoms but having differing average degrees of polymerization; GLUCOPON® 625 and GLUCOPON® 600, each described to be an alkyl polyglycoside in which the alkyl groups contains 12 to 16 carbon atoms but having a different average degrees of polymerization; PLAN- TAREN® 2000, described to be a $C_{8-16}$alkylpolyglycoside; PLANTAREN® $C_{12-16}$ alkylpolyglycoside; PLANTAREN® 1200, described to be a $C_{12-16}$ alkylpolyglycoside. Each of these materials are presently commercially available from Cognis. Other examples include alkyl polyglycoside surfactant compositions which are comprised of mixtures of compounds of the aforesaid formula wherein Z represents a moiety derived from a reducing saccharide containing 5 or 6 carbon atoms; a is zero; b is a number from 1.8 to 3; and R is an alkyl radical having from 8 to 20 carbon atoms.

Particularly preferred alkylpolyglycoside compounds are those according to the structure:

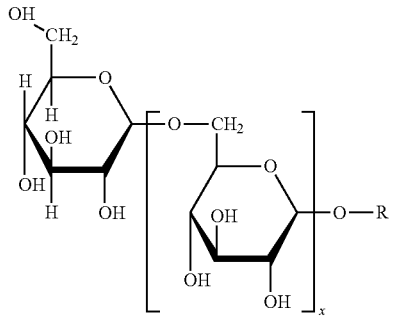

wherein:

R is an alkyl group, preferably a linear alkyl chain, which comprises $C_8$ to $C_{16}$ alkyl groups;

x is an integer value of from 0-3, inclusive.

Examples of such particularly preferred alkylpolyglycoside compounds include: where R is comprised substantially of $C_8$ and $C_{10}$ alkyl chains yielding an average value of about 9.1 alkyl groups per molecule (GLUCOPON 220 UP, GLUCOPON 225 DK); where R is comprised of $C_8$, $C_{10}$, $C_{12}$, $C_{14}$ and $C_{16}$ alkyl chains yielding an average value of about 10.3 alkyl groups per molecule (GLUCOPON 425N); where R is comprised substantially of $C_{12}$, $C_{14}$ and $C_{16}$ alkyl chains yielding an average value of about 12.8 alkyl groups per molecule (GLUCOPON 600 UP, GLUCOPON 625 CSUP, and GLUCOPON 625 FE, all of which are available from Cognis). Also useful as the alkylpolyglycoside compound is TRITON CG-110 (Union Carbide Corp. subsidiary of Dow Chemical). Further examples of commercially available alkylglycosides as described above include, for example, GLUCOPON 325N which is described as being a 50% $C_9$-$C_{11}$ alkyl polyglycoside, also commonly referred to as D-glucopyranoside (from Cognis). Particularly preferred as the alkylpolyglycoside-based nonionic surfactant compounds include those illustrated in the Examples.

In preferred embodiments, the inventive compositions necessarily require at least one nonionic surfactant based on a monobranched alkoxylated $C_{10}$-fatty alcohols and/or $C_{11}$-fatty alcohols; these are jointly referred to as $C_{10}/C_{11}$-fatty alcohols. These materials are nonionic surfactants are monobranched and may have various degrees of alkoxylation, and are typically ethoxylated with between about 3 and 14 moles of ethylene oxide, typically 4, 5, 6, 7, 8, 9, 10 or 14 moles ethylene oxide. Preferably these nonionic surfactants are derived from corresponding Guerbet alcohols. Such nonionic surfactants are presently commercially available under the Lutensol® (ex. BASF AG) and are available in a variety of grades e.g., Lutensol® XP 40 recited by its supplier to be a $C_{10}$-Guerbet alcohol with approximately 4 moles of ethoxylation, Lutensol® XP 50 recited by its supplier to be a $C_{10}$-Guerbet alcohol with approximately 5 moles of ethoxylation, Lutensol® XP 60 recited by its supplier to be a $C_{10}$-Guerbet alcohol with approximately 6 moles of ethoxylation, Lutensol® XP 70 recited by its supplier to be a $C_{10}$-Guerbet alcohol with approximately 7 moles of ethoxylation, Lutensol® XP 40 recited by its supplier to be a $C_{10}$-Guerbet alcohol with approximately 4 moles of ethoxylation, Lutensol® XP 79 recited by its supplier to be a $C_{10}$-Guerbet alcohol with approximately 7 moles of ethoxylation, Lutensol® XP 80 recited by its supplier to be a $C_{10}$-Guerbet alcohol with approximately 8 moles of ethoxylation, Lutensol® XP 89 recited by its supplier to be a $C_{10}$-Guerbet alcohol with approximately 8 moles of ethoxylation, Lutensol® XP 90 recited by its supplier to be a $C_{10}$-Guerbet alcohol with approximately 9 moles of ethoxylation, Lutensol® XL 99 recited by its supplier to be a $C_{10}$-Guerbet alcohol with approximately 9 moles of ethoxylation, Lutensol® XL 100 recited by its supplier to be a $C_{10}$-Guerbet alcohol with approximately 10 moles of ethoxylation, Lutensol® XL 140 recited by its supplier to be a $C_{10}$-Guerbet alcohol with approximately 14 moles of ethoxylation, all available from BASF AG. While the foregoing materials are ethoxylated, it is to be understood that other alkoxylated, e.g., propoxylated, butoxylated, as well as mixed ethoxylated and propoxylated branched nonionic alkyl polyethylene glycol ether may also be used.

It is contemplated by the inventor that similar nonionic surfactants based on monobranched alkoxylated $C_{11}$-fatty alcohols may be used to substitute part of, or all of, the foregoing identified nonionic surfactant based on monobranched alkoxylated $C_{10}$-fatty alcohols. These include for example, the Genapol® UD series described as tradenames Genapol® UD 030, $C_{11}$-oxo-alcohol polyglycol ether with 3 EO; Genapol® UD, 050 $C_{11}$-oxo-alcoholpolyglycol ether with 5 EO; Genapol® UD 070, $C_{11}$-oxo-alcohol polyglycol ether with 7 EO; Genapol® UD 080, $C_{11}$-oxo-alcoholpolyglycol ether with 8 EO; Genapol® UD 088, $C_{11}$-oxo-alcoholpolyglycol ether with 8 EO; and Genapol® UD 110, $C_{11}$-oxo-alcoholpolyglycol ether with 11 EO (ex. Clariant).

The total amount of the nonionic surfactant constituent present in the inventive composition is from about 0.05%-7.5% by weight, more desirably from about 0.01%-5% by weight, based on the total weight of the compositions of which the nonionic surfactant constituent forms a part. Preferably however, the nonionic surfactant constituent preferably comprises both about 0.5-2.5% wt. of a first alcohol ethoxylate nonionic surfactant derived from monobranched alkoxylated $C_{10}$-fatty alcohols and/or $C_{11}$-fatty alcohols and about 0.05-0.5% wt. of a second alcohol ethoxylate nonionic surfactant, preferably a $C_{10}$-$C_{14}$ linear alcohol ethoxylated surfactant having at least about 8 mols ethoxylation. Most desirably the nonionic surfactant constituent consists essentially of a pair of such individual nonionic surfactants are present respective weight ratios of about 25-3:1, more preferably about 15-5:1 and most preferably between about 12-7:1 of the former to the latter said individual nonionic surfactants The identity of, and preferred amounts of particularly preferred nonionic surfactants as well as respective weight ratios are disclosed with reference to one or more of the following Examples.

The inventive compositions may further comprise about 0-5% wt. of one or more further surfactants which may include amphoteric or zwitterionic surfactants, but the inventive compositions expressly exclude cationic surfactants as such may form undesirable complexes with the anionic surfactants present. Typical examples of amphoteric or zwitterionic surfactants are alkyl betaines, alkyl amidobetaines, aminopropionates, aminoglycinates, imidazolinium betaines and sulfobetaines. A particularly preferred amphoteric surfactant is N-(2-carboxyethyl)-N-[3-(decyloxy)propyl]-beta-alaninate which may be used as a free acid, or as a salt form thereof, e.g. a sodium salt form.

Further useful amphoteric surfactants include alkylampho (mono)acetates having the formula

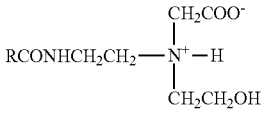

as well as one or more alkylampho(di)acetates according to the formula/ae

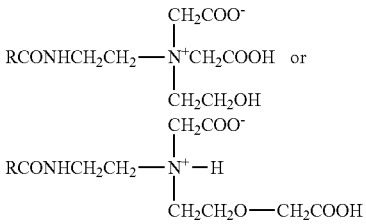

as well as alkylampho(mono)proprionates according to the formula

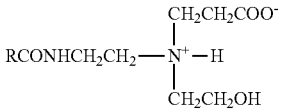

as well as one or more alkylampho(di)proprionates according to the formula/ae

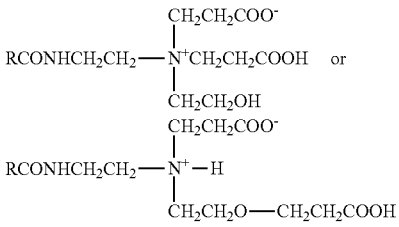

In the above formulae, R represents a $C_8$ to $C_{24}$ alkyl group, and is preferably a $C_{10}$ to $C_{16}$ alkyl group. Examples of these amphoteric surfactants can be found under the tradename Miranol from Rhodia (Cranbury, N.J.). Some examples include Miranol C2M-Conc. NP, described to be disodium cocoamphodiacetate; Miranol FA-NP, described to be sodium cocoamphotacetate; Miranol DM, described to be sodium steroamphoacetate; Miranol HMA, described to be sodium lauroamphoacetate; Miranol C2M, described to be cocoamphodiprioponic acid; Miranol C2M-SF, described to be disodium cocoamphodiproprionate; Miranol CM-SF Conc., described as being cocoamphopropriate; Mirataine H2C-HA, described as sodium lauiminodiproprionate; Miranol Ultra L-32, described as sodium lauroamphoacetate; and Miranol Ultra C-37, described as sodium cocoamphoacetate. Other amphoteric surfactants are also available under the tradename Amphoterge from Lonza (Fair Lawn, N.J.) such as Amphoterge K described to sodium cocoamphoproprionate; Amphoterge K-2, described as disodium cocoamphodiproprionate; Amphoterge W, described to be sodium cocoamphoacetate; and Amphoterge W-2, described to be disodium cocoamphodiacetate.

Further useful amphoteric surfactants include those which may be represented by the following general formula

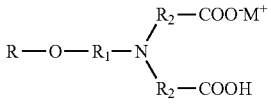

in which, R represents a $C_4$ to $C_{24}$ alkyl group, and is preferably a $C_{10}$ to $C_{16}$ alkyl group, $R_1$ and $R_2$ independently represent a $C_1$ to $C_8$ alkyl group, is preferably —$CH_2CH_2$— or —$CH_2CH_2CH_2$—, and M may be any salt-forming anion which permits water solubility or water miscibility of the compound, e.g., chloride, bromide, methosulfate, ethosulfate, lactate, saccharinate, acetate or phosphate. Such compounds are presently commercially available, such as those marketed in the Tomamine Amphoteric series of amphoteric surfactants, ex. Air Products Inc.

Further useful amphoteric surfactants are $C_{12}$-$C_{18}$ acylamido alkylene amino alkylene sulfonates, e.g., compounds having the formula R—C(O)—NH—($C_2H_4$)—N($C_2H_4OH$)—$CH_2CH(OH)CH_2SO_3M$ wherein R is an alkyl group containing from about 9 to about 18 carbon atoms and M is a compatible cation; such amphoteric surfactants are available as Miranol® CS, OS, JS, etc. surfactants. Many of said amphoteric surfactants are generally referred to as cocoamphohydroxypropyl sulfonates.

Particularly preferred amphoteric or zwitterionic surfactants are disclosed with reference to one or more of the following Examples.

The compositions of the invention necessarily comprise about 0.01-5% wt. of an organic solvent constituent, which preferably comprises, or more preferably consists of a phenyl containing glycol ether solvent. The organic solvent constituent comprises one or more organic solvents selected from alcohols, glycols, acetates, ether acetates and glycol ethers. Exemplary alcohols include $C_1$-$C_8$ alcohols which may be straight chained or branched, and may be primary, secondary, tertiary alcohols as well as $C_1$-$C_8$ polyols. Exemplary glycol ethers include those glycol ethers having the general structure $R_a$—O—$R_b$—OH, wherein $R_a$ is an alkoxy of 1 to 20 carbon atoms, or aryloxy of at least 6 carbon atoms, and $R_b$ is an ether condensate of propylene glycol and/or ethylene glycol having from one to ten glycol monomer units. Preferred are glycol ethers having one to five glycol monomer units. These are $C_3$-$C_{20}$ glycol ethers By way of further non-limiting example specific organic solvent constituents useful in the organic co-solvent constituent include propylene glycol methyl ether, dipropylene glycol methyl ether, tripropylene glycol methyl ether, propylene glycol n-propyl ether, ethylene glycol n-butyl ether, diethylene glycol n-butyl ether, diethylene glycol methyl ether, propylene glycol, ethylene glycol, isopropanol, ethanol, methanol, diethylene glycol monoethyl ether acetate and particularly advantageously ethylene glycol hexyl ether, diethylene glycol hexyl ether, as well as the $C_3$-$C_8$ primary and secondary alcohols.

As noted a particularly preferred organic solvents of the organic solvent constituent are one or more phenyl containing glycol ether solvents including those which may be represented by the following general structural representation (I):

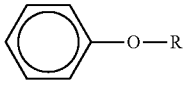

(I)

wherein R is a $C_1$-$C_6$ alkyl group which contains at least one —OH moiety, and preferably R is selected from: $CH_2OH$, $CH_2CH_2OH$, $CH(OH)CH_3$, $CH(OH)CH_2OH$, $CH_2CH_2CH_2OH$, $CH_2CH(OH)CH_3$, $CH(OH)CH_2CH_3$, $CH(OH)CH_2CH_2OH$, $CH(OH)CH(OH)CH_3$, and $CH(OH)CH(OH)CH_2OH$, and the phenyl ring may optionally substituted with one or more further moieties such as $C_1$-$C_3$ alkyl groups but is preferably unsubstituted. A specific useful phenyl containing glycol ether solvent is commercially supplied as DOWANOL PPH, described to be a propylene glycol phenyl ether which is described by it supplier as being represented by the following structural representation (II):

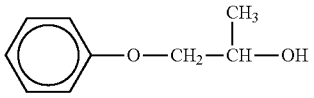

(II)

and further, indicated is that the major isomer is as indicated, which suggests that other alkyl isomers are also present. One or more such phenyl containing glycol ether solvents may be used in the organic solvent system, but preferably the inventive compositions comprise a single phenyl containing glycol ether solvent, and especially preferably the sole phenyl containing glycol ether solvent present in the compositions is propylene glycol phenyl ether which has been found to be unusually effective. The phenyl containing glycol ether solvents comprise 0-100 parts or % of the organic solvent constituent, and in order of increasing preference comprise: 5, 10, 15, 20, 25, 30, 35, 40, 45, 50, 55, 60, 65, 70, 75, 80, 85, 90, 95, 97, 98, 99 and 100 parts or % of the organic solvent constituent. In particularly preferred embodiments, the phenyl containing glycol ether(s), and more preferably, a propylene glycol phenyl ether (DOWANOL PPH), is the sole non-aqueous solvent present in the compositions of the invention.

The compositions of the invention comprise 0.01-5% wt. of an organic solvent constituent, preferably in order of increasing preference, at least about: 0.05, 0.1, 0.15, 0.2, 0.25, 0.3, 0.35, 0.4, and 0.45% wt. of the organic solvent constituent. Preferably, and in order of increasing preference, the inventive compositions comprise not in excess of about 5, 4.5, 4, 3.75, 3.5, 3.25, 3, 2.75, 2.5, 2.25, 2, 1.75, 1.5, 1.25, 1, 0.9, 0.8, 0.7, 0.6, 0.5% wt. of the organic solvent constituent.

The inventive compositions may comprise 0-5% wt. of one or more alkanolamines, which may provide alkalinity to compositions, as well as simultaneously providing excellent removal of hydrophobic soils which may be encountered, e.g., greases and oils. For the purposes of this patent specification, alkanolamines are not considered to be organic solvents. Exemplary useful alkanolamines include monoalkanolamines, dialkanolamines, trialkanolamines, and alkylalkanolamines such as alkyl-dialkanolamines, and dialkyl-monoalkanolamines. The alkanol and alkyl groups are generally short to medium chain length, that is, from 1 to 7 carbons in length. For di- and trialkanolamines and dialkyl-monoalkanolamines, these groups can be combined on the same amine to produce for example, methylethylhydroxypropylhydroxylamine. One of skill can readily ascertain other members of this group. The alkanolamine constituent may be a single alkanolamine, or may be a plurality of alkanolamines as well. Particularly preferred as the alkanolamine constituent is monoethanolamine which has found to be effective both as an alkalinity source and as a cleaning component. In certain particularly preferred embodiments the alkalinity constituent of the invention consists solely of a single alkanolamine, preferably selected from monoalkanolamines, dialkanolamines, trialkanolamines of 1 to 7 carbons in length, preferably is a single monoalkanolamine selected from linear monoethanolamine, monopropanolamine or monobutanolamine, and especially preferably is monoethanolamine, which is advantageously present to the exclusion of other alkanolamines. The one or more alkanolamines comprise about 0-5% wt., preferably about 0.1-1% wt and especially preferably one or more of the amounts demonstrated in the examples.

As further essential constituents, the inventive compositions comprise about 2-15% wt., preferably about 5-12% wt. and especially preferably about 7-12% wt. of an acid system, which in particularly preferred embodiments the acid system comprises each of sulfamic acid, formic acid and oxalic acid as a ternary acid system, and wherein these three acids or salts thereof are present in a respective weight ratio of sulfamic acid:formic acid:oxalic acid of 1-8:1-5:1-3, and in order of increasing preference: 1-5:1-2.5:1-2; 2-5:1-2:1-1.5; 3-5:1.2-2:1-1.5; 3-4.5:1.2-1.6:1-1.25; and 4-4.5:1.2-1.5:1-1.2. Especially preferably the respective weight ratio of sulfamic acid:formic acid:oxalic acid is about 5:1.7:1.2, or about 4.1:1.4:1. The inventors have surprisingly found that the foregoing ternary acid system provides excellent technical performance, including cleaning of hard surfaces as well as good product storage stability, and while this ternary acid system imparts a low pH, preferably not in excess of 1, the product is acceptable for consumer usage in the cleaning treatment of hard surfaces.

The compositions of the invention may include as part of the acid constituent one or more further organic acids. Exemplary useful organic acids include any known art organic acid which may be found effective. Generally useful organic acids are those which include at least one carbon atom, and include at least one carboxyl group (—COOH) in its structure. Preferred are water soluble organic acids which contain from 1 to about 6 carbon atoms, and at least one carboxyl group as noted, and exemplary useful organic acids include: linear aliphatic acids such as acetic acid, propionic acid, butyric acid and valeric acid; dicarboxylic acids such as malonic acid, succinic acid, glutaric acid, adipic acid, pimelic acid, fumaric acid and maleic acid; acidic amino acids such as glutamic acid and aspartic acid; and hydroxy acids such as glycolic acid, lactic acid, hydroxyacrylic acid, alpha-hydroxybutyric acid, glyceric acid, tartronic acid, malic acid, tartaric acid and citric acid, as well as acid salts of these organic acids.

The acid constituent may also include one or more inorganic acids, e.g., including: sulfuric acid, phosphoric acid, potassium dihydrogenphosphate, sodium dihydrogenphosphate, sodium sulfite, potassium sulfite, sodium pyrosulfite (sodium metabisulfite), potassium pyrosulfite (potassium metabisulfite), acid sodium hexametaphosphate, acid potassium hexametaphosphate, acid sodium pyrophosphate, acid potassium pyrophosphate, and hydrochloric acid. Other water dispersible or water soluble inorganic or mineral acids not specifically elucidated herein may also be used.

In preferred embodiments the acid constituent expressly excludes inorganic acids, with the exception (proviso) that sulfamic acid may be present.

In certain preferred embodiments the acid constituent excludes other organic acids, with the exception (proviso) that formic acid, oxalic acid and citric acid may be present.

The acid constituent comprises 2-15% wt. of the inventive compositions. In preferred embodiments the acid constituent comprises, in order of increasing preference, at least about 2, 2.5, 3, 3.5, 4, 4.5, 5, 5.5, 6, 6.5, 7, 7.5, 8% wt. of an inventive composition. In preferred embodiments, the acid constituent comprises, in order of increasing preference not in excess of about 12, 11, 10.5, 10, 9.5, 9, 8.5, 8% wt. of an inventive composition.

The compositions of the invention optionally but in certain cases desirably include a fragrance constituent. Such fragrances which may be natural or synthetically produced. Fragrance raw materials may be divided into three main groups: (1) the essential oils and products isolated from these oils; (2) products of animal origin; and (3) synthetic chemicals. Fragrance compositions as received from a supplier may be provided as an aqueous or organically solvated composition, and may include as a hydrotrope or emulsifier a surface-active agent, typically a surfactant, in minor amount, generally not in excess of about 1.5% wt. Such fragrance compositions are quite usually proprietary blends of many different specific fragrance compounds. However, one of ordinary skill in the art, by routine experimentation, may easily determine whether such a proprietary fragrance composition is compatible in the compositions of the present invention.

Such fragrances may be added in any conventional manner, admixing to a composition or blending with other constituents used to form a composition, in amounts which are found to be useful to enhance or impart the desired scent characteristic to the composition, and/or to cleaning compositions formed therefrom.

Water is the primary constituent of the inventive compositions as the compositions are largely aqueous in nature, and comprise at least 85% wt., preferably at least about 80% wt. water, more preferably at least about 90% wt. water. The amount of water is added to order to provide to 100% by weight of the compositions of the invention. The water may be tap water, but is preferably distilled water, and is most preferably deionized water or soft water.

Optionally the inventive compositions may further include one or more optional constituents directed to improving the aesthetic or functional features of the inventive compositions. Such conventional additives known to the art include but not expressly enumerated here may also be included in the compositions according to the invention. By way of non-limiting example without limitation these may include: chelating agents, colorants, fragrances, thickening agents, viscosity modifying constituents, hydrotropes, pH adjusting agents, pH buffers and the like. Many of these materials are known to the art, per se. Such optional, i.e., non-essential constituents should be selected so to have little or no detrimental effect upon the desirable characteristics of the present invention. When present, the one or more optional constituents present in the inventive compositions do not exceed about 10% wt., preferably do not exceed 8% wt., and most preferably do not exceed 5% wt. of the composition of which they form a part.

The inventive compositions are readily pourable and pumpable, and are liquids at room temperature, exhibiting a viscosity in the range of from about 1 cP to about 50 cP at such environmental conditions.

The inventive compositions are easily produced by any of a number of known art techniques. Conveniently, a part of the water is supplied to a suitable mixing vessel further provided with a stirrer or agitator, and while stirring, the remaining constituents are added to the mixing vessel, including any final amount of water needed to provide to 100% wt. of the inventive composition.

The composition provided according to the invention can be desirably provided as a consumer product in a manually openable and resealable storage container, which may be either rigid or may be a deformable "squeeze bottle" type dispenser. Preferably however the composition is advantageously provided in a bottle, flask or other reservoir and dispensed via a nozzle or a pump, e.g., a manually operable pump or a manually operable trigger spray to a hard surface requiring treatment. The inventive compositions may also be provided to a pressurizable container, e.g., an aerosol container with a suitable amount, typically up to about 10% wt. based on the weight of the inventive composition, of an aerosol propellant, e.g., a hydrocarbon, of from 1 to 10 carbon atoms, such as n-propane, n-butane, isobutane, n-pentane, isopentane, and mixtures thereof or a non-hydrocarbon gas, e.g., $CO_2$, $N_2$, etc. or for that matter, even pressurized air. The inventive compositions are advantageously used in the cleaning treatment of hard surfaces, as the hard surface cleaning composition according to the invention is desirably provided as a ready to use product which may be directly applied to a hard surface. The composition may be applied directly from a product container as a liquid, or may be applied as a wipe article preimpregnated with a quantity of the said composition.

The compositions may be used in the cleaning treatment of a hard surface which method may be effectuated by applying a cleaning effective amount of a composition taught therein, and optionally thereafter wiping the treated hard surface to remove at least a part of the composition from the hard surface.

Illustrative example compositions which were produced include those set forth below. The illustrative example compositions demonstrate particularly preferred embodiment of the invention as well as preferred weight percentages as well as preferred relative weight percentages/weight ratios with regard to the respective individual constituents present within the composition.

EXAMPLES

Examples the inventive hard surface treatment compositions are described in the following Table 1; the constituents indicated on Table 1 used to produce the formulations were used on an "as supplied" basis; the identity of these constituents are disclosed in more detail on Table 2. The hard surface treatment compositions were produced by mixing the constituents into water as outlined in Table 1 in a beaker at room temperature which was stirred with a conventional magnetic stirring rod or paddle mixer; stirring continued until the formulation was homogenous in appearance. It is to be noted that the constituents might be added in any order, but it is preferred that a first premixture is made of any fragrance constituent with one or more surfactants and/or hydrotrope in an aliquot of water used in the inventive hard surface treatment compositions. The order of addition is not critical, but good results are obtained where the surfactants (which may be also the premixture of the fragrance and surfactants) are produced prior to the addition of the remaining constituents to the water. The amounts of the named constituents are indicated in % w/w based on a total weight of the hard surface treatment composition of which they form a part. The total amount of water present in each composition was based on the amount of water provided via one or more of the named constituents.

TABLE 1

| | E1 | E2 | E3 | E4 | E5 | E6 | E7 | E8 |
|---|---|---|---|---|---|---|---|---|
| sulfamic acid | 5 | 5 | 5 | 5 | 5 | 5 | 5 | 5 |
| formic acid (85%) | 2 | 2 | 2 | 2 | 2 | 2 | 2 | 2 |
| oxalic acid | 1.2 | 1.2 | 1.2 | 1.2 | 1.2 | 1.2 | 1.2 | 1.2 |
| Biosoft S101 (70%) | 0.2 | 0.2 | 0.2 | 0.2 | — | — | 0.2 | 0.2 |
| Neodol 91-6 | — | — | — | — | 2.0 | 1 | — | — |
| Lutensol XP89 | 1.8 | 1.8 | 1.8 | 1.8 | — | 0.8 | 1.0 | — |
| Lutensol XP99 | — | — | — | — | — | — | 0.8 | 1.8 |
| Empilan KB10 | 0.2 | 0.2 | 0.2 | 0.53 | — | 0.2 | 0.2 | 0.2 |
| Glucopon 425N (50%) | — | 0.65 | — | — | — | — | — | — |
| Dowanol PPH | 0.45 | 0.45 | 0.45 | 0.45 | 0.43 | 0.45 | 0.45 | 0.45 |
| MEA | — | — | — | 0.06 | — | — | — | — |
| fragrance | 0.15 | 0.15 | 0.15 | 0.15 | 0.15 | 0.15 | 0.15 | 0.15 |
| water | q.s. | q.s. | q.s. | q.s. | q.s. | q.s. | q.s. | q.s. |
| pH | 0.91 | 0.91 | 0.91 | 0.91 | >1 | >1 | >1 | >1 |
| appearance | clear | clear | clear | clear | clear | clear | clear | clear |
| ASTM Wallboard grease removal (%) | 80.81 | 76.25 | 84.97 | 80.51 | 66.49 | 71.51 | 76.46 | 69.72 |
| limescale removal (%) | 0.69 | n.t. | n.t. | n.t. | n.t. | n.t. | n.t. | n.t. |
| IKW soapscum removal (%) | 100 | 100 | 100 | 100 | n.t. | n.t. | n.t. | n.t. |

| | E9 | E10 | E11 | E12 |
|---|---|---|---|---|
| sulfamic acid | 5 | 5 | 5 | 5 |
| formic acid (85%) | 2 | 2 | 2 | 2 |
| oxalic acid | 1.2 | 1.2 | 1.2 | 1.2 |
| Biosoft S101 (70%) | 0.2 | 0.2 | 0.2 | 0.1 |
| Neodol 91-6 | — | — | — | — |
| Lutensol XP89 | 1.8 | 1.0 | 1.8 | 1.8 |
| Lutensol XP99 | — | 0.8 | — | — |
| Empilan KB10 | 0.2 | 0.2 | 0.2 | — |
| Amphoteric SC (35%) | 0.57 | — | 0.71 | 0.71 |
| Dowanol PPH | 0.45 | 0.45 | 0.45 | 0.45 |
| fragrance | 0.15 | 0.15 | 0.15 | 0.15 |
| water | q.s. | q.s. | q.s. | q.s. |
| pH | >1 | >1 | >1 | >1 |
| appearance | blue tinted | clear | clear | blue tinted |
| ASTM Wallboard grease removal (%) | 78.16 | 74.3 | 80.96 | 71.72 |
| limescale removal (%) | n.t. | n.t. | n.t. | n.t. |
| IKW soapscum removal (%) | 100 | 100 | n.t. | n.t. |

n.t.—indicates "not tested"

The constituents of Table 1 are more fully described on the following Table 2.

TABLE 2

| | |
|---|---|
| sulfamic acid | sulfamic acid (100% wt. actives), laboratory grade |
| formic acid (85%) | formic acid (100% wt. actives), laboratory grade |
| oxalic acid | oxalic acid (100% wt. actives), laboratory grade |
| Biosoft S101 (70%) | alkylbenzene sulfonic acid (70% wt. actives) |
| Neodol 91-6 | nonionic surfactant, $C_9$—$C_{11}$ alcohol ethoxylate (6 mols EO, avg.) (98-100% wt. actives) ex. Shell Co. |
| Lutensol XP89 | nonionic surfactant, $C_{10}$-Guerbet alcohol with approximately 8 moles of ethoxylation (95-100% wt. actives) ex. BASF AG |
| Lutensol XP99 | nonionic surfactant, $C_{10}$-Guerbet alcohol with approximately 9 moles of ethoxylation (95-100% wt. actives) ex. BASF AG |
| Empilan KB10 | $C_{12}$—$C_{14}$ linear alcohol ethoxylate, 10 mols ethoxylation, e.g. Empilan KB10 ($C_{12}$—$C_{14}$ alcohol, 10EO), 100% wt. actives, ex. Albright & Wilson |
| Glucopon 425N (50%) | alkylpolyglucoside based nonionic surfactant (50% wt. actives) |
| Amphoteric SC (35%) | N-(2-carboxyethyl)-N-[3-(decyloxy)propyl]-beta-alaninate, sodium salt (35% wt. actives) supplied as "Tomamine Amphoteric SC" (ex. Air Products) |
| Dowanol PPH | propylene glycol phenyl ether (100% wt. actives) ex. Dow Chem. Co. |
| MEA | monoethanolamine (100% wt. actives) laboratory grade |
| fragrance | fragrance composition, proprietary composition of its supplier |
| water | deionized water |

Cleaning of Organic Soil (Greasy Wallboard):

Cleaning evaluations of certain of the compositions described on Table 1 were performed in accordance with the testing protocol outlined according to ASTM D4488 A2 Test Method, which evaluated the efficacy of the cleaning compositions in removing a standardized greasy organic soil on masonite wallboard samples painted with white wall paint. The soil applied was a standardized greasy soil containing.

| Test Greasy Soil | % w/w |
|---|---|
| vegetable oil | 33 |
| vegetable shortening | 33 |
| lard | 33 |
| carbon black | 1 |

which were blended together to homogeneity under gentle heating to form a uniform mixture which was later allowed to cool to room temperature. The sponge (water dampened) of a Gardner Abrasion Tester apparatus was squirted with a 15 gram sample of a tested cleaning composition, and the apparatus was cycled 2 to 6 times. The test was replicated 4 times for each tested composition. the cleaning efficacy of the tested compositions was evaluated utilizing a high resolution digital imaging system which evaluated the light reflectance characteristics of the each tested sample wallboard sample. This system utilized a photographic copy stand mounted within a light box housing which provided diffuse, reflected light supplied by two 15 watt, 18 inch type T8 fluorescent bulbs rated to have a color output of 4100K which approximated "natural sunlight" as noted by the manufacturer. The two fluorescent bulbs were positioned parallel to one another and placed parallel and beyond two opposite sides of the test substrate (test tile) and in a common horizontal plane parallel to the upper surface of the test substrate being evaluated, and between the upper surface of the tile and the front element of the lens of a CCD camera. The CCD camera was a "QImaging Retiga series" CCD camera, with a Schneider-Kreuznach Cinegon Compact Series lens, f1.9/10 mm, 1 inch format (Schneider-Kreuznach model #21-1001978) which CCD camera was mounted on the copy stand with the lens directed downwardly towards the board of the copy stand on which a test substrate was placed directly beneath the lens. The light box housing enclosed the photographic copy stand, the two 18 inch fluorescent bulbs and a closeable door permitted for the insertion, placement and withdrawal of a test tile which door was closed during exposure of the CCD camera to a test tile. In such a manner, extraneous light and variability of the light source during the evaluation of a series of tested substrates was minimized, also minimizing exposure and reading errors by the CCD camera.

The CCD camera was attached to a desktop computer via a Firewire IEEE 1394 interface and exposure data from the CCD camera was read by a computer program, "Media Cybernetics Image Pro Plus v. 6.0", which was used to evaluate the exposures obtained by the CCD camera, which were subsequently analyzed in accordance with the following. The percentage of the test soil removal from each test substrate (tile) was determined utilizing the following equation:

$$\% \text{ Removal} = \frac{RC - RS}{RO - RS} \times 100$$

where

RC=Reflectance of tile after cleaning with test product

RO=Reflectance of original soiled tile

RS=Reflectance of soiled tile

The results of this evaluation was averaged for each of the tested compositions, and the results of the evaluation are reported on prior Table 1. As is evidenced from the foregoing results, the compositions of the invention according to Table 1 exhibited excellent greasy soil removal according to the ASTM based protocol described, which was surprising in view of the low pH values of each tested composition. Preferred compositions of the invention exhibited better greasy soil removal than other examples of Table 1. As is seen from the table, the compositions of the invention exhibited good removal of the ASTM grease compositions from the wallboard samples, which was surprising in view of the highly acidic compositions. Particularly preferred compositions of the invention scored at least about 80% removal of the of the ASTM wallboard grease according to the foregoing protocol.

Soap Scum Cleaning Evaluation:

The efficacy of the example compositions according to the invention as well as that of the commercially available products in removing soap scum from a hard surface was evaluated. The test protocol used was that established by the German Cosmetic, Toiletry, Perfumery and Detergent Association (IKW, viz., the "Industrieverband Körperpflege- and Waschmittel e.V.") and published as "Recommendations for the Quality Assessment of Bathroom Cleaners" (version 2002), published in the SÖFW-Journal, 129, November, 2003. The specific test of the published tests used based on that under "3.2 Determination of the cleaner's ability to remove lime soaps", which was generally adhered to as indicated in the following.

For this test high-gloss white ceramic tiles (4 inch by 4 inch glazed glossy white ceramic bathroom tiles), were initially cleaned with a mild abrasive cleaner, rinsed with water and wiped with ethanol. Subsequently the tiles are dried for 1 hour at 180° C. in a preheated drying cabinet and then weighed.

The test soil used was a calcium stearate suspension of the following composition:

85.0% ethanol, 96 MEK (denatured)

5.0% calcium stearate, fine 9.8% water, demineralized 0.2% soot/special black 4

Ethanol was made ready and calcium stearate was stirred into it. Then water and soot were added. The suspension was placed in an ultrasonic bath for 10 minutes and subsequently homogenized over 3 minutes with a Turrax (approx. 5000/min).

The suspension was applied onto the tiles from a distance of approximately. 25 cm with an airbrush pistol, (e.g. Badger model 150 with jet L). As a consequence of adjusting the airbrush system some of the ethanol was blown out by the compressed air (recommended pressure 2 bar), therefore the quantity to be applied was determined in pretests.

The tiles were dried for 1 hour at room temperature and then stored for 1 hour in a horizontal position in a preheated circulating drying oven at 180° C. in order to melt the calcium stearate. Cooling was allowed to take place for approx. 1 hour in the switched off and slightly opened drying oven. The effectively applied mass of calcium stearate was calculated by another weighing and by determining the difference in weight compared with the empty, dried tile. According to the mass of the 5% calcium stearate suspension was applied (=5 g), in the test only tiles are used onto which 0.25 g±0.02 g of calcium stearate had been melted. Before testing the tiles were stored for at least 24 hours at room temperature.

Testing was carried out in the form of a six fold determination. For this purpose 0.5 ml of undiluted cleaner was placed with a pipette on an area of 3×2 cm on the tile for one of several contact times. Each of the tested compositions were evaluated by using six tile replicates for each contact time tested. The contact times were 2.5 minutes, 5 minutes, 7 minutes and 10 minutes. Subsequently each tile was rinsed under running water, and the loosened calcium stearate was removed mechanically by wiping a moist, fine-pored viscose sponge (approx. 90×40×40 mm) once across the surface of the tile without applying any pressure Then each tile was rinsed with fully demineralized water and dried at room temperature.

After drying the cleaning performance of each test tile and composition was visually assessed by three trained observers for each test tile, who estimated the soil removal in percent. To reduce variations of assessments, the observers were trained using suitable evaluation samples; the ratings established by the observers were relative to a sample soiled tile which was used as a "0%" removal reference, and a clean unsoiled tile which was used as a "100%" removal reference. The cleaning performance for each of the tested compositions was arrived at from the mean value of the reported soil removal for each tested composition as reported by the three trained observers. The results are reported on Table 1. As can be seen from the foregoing results, the compositions provided excellent soap-scum removal from the test substrates, which was surprising in view of their highly acidic pH. Particularly preferred compositions of the invention exhibited at least about 90%, 95%

IKW soapscum removal

Limescale Dissolution Evaluation:

The efficacy of compositions of the invention in the removal of limescale was evaluated by the following test.

Several pre-weighed and dried marble cubes (measured in grams) were first prepared by rinsing them with copious amounts of deionized water and subsequently the rinsed marble cubes were placed into a 105° C. oven for at least one hour in order to fully dry. The marble cubes were then removed from the oven, and allowed to cool to room temperature (approx. 20° C.) and each was then individually weighed on an analytical balance. Thereafter, for each tested formulation tested, two marble cube was placed into separate a trays, and 8 ml of a test composition was placed on top of the cube and allowed to remain there for 5 minutes for the first cube, and 10 minutes for the second cube, after which the cubes were then individually rinsed with copious amounts of deionized water and again, after rinsing, each of the cubes was placed into a 105° C. oven for at least one hour in order to fully dry. Subsequently the cubes were allowed to cool to room temperature and reweighed.

The percentage loss of each of the cubes was calculated, and the results are reported on Table 1. As is evident from the foregoing results, the tested compositions provided a good degree of dissolution of the marble cubes tested.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of the appended claims.

The invention claimed is:

1. An acidic hard surface cleaning compositions comprising:

about 0.05-1% wt. of one or more anionic surfactants;

about 0.05-7.5% wt. of a nonionic surfactant constituent which said constituent preferably both about 0.5-2.5% wt. of a first alcohol ethoxylate nonionic surfactant derived from monobranched alkoxylated $C_{10}$-fatty alcohols and/or $C_{11}$-fatty alcohols and about 0.05-0.5% wt. of a second alcohol ethoxylate nonionic surfactant;

about 0-5% wt. of one or more further surfactants selected from amphoteric or zwitterionic surfactants, but which expressly exclude cationic surfactants;

about 0.01-5% wt. of an organic solvent constituent;

about 0-5% wt. of an alkanolamine;

about 2-15% wt. of an acid constituent which comprises a ternary acid system comprising each of: sulfamic acid, formic acid and oxalic acid in a respective weight ratio of sulfamic acid:formic acid:oxalic acid of 1-8:1-5:1-3;

optionally one or more further constituents which are directed to improving one or more aesthetic or functional features of the composition, which may be present in a cumulative amount of not in excess of about 10% wt. of the total of the composition of which they form a part, at least 85% wt. water;

wherein the compositions have a pH of about 2 or less and further wherein the compositions exhibit good removal of greasy stains and concurrently also exhibit good soap-scum removal from hard surfaces.

2. The acidic hard surface cleaning composition according to claim 1, wherein:

the organic solvent constituent comprises a phenyl containing glycol ether solvent.

3. The acidic hard surface cleaning composition according to claim 1, wherein:

the organic solvent constituent consists of a phenyl containing glycol ether solvent.

4. The acidic hard surface cleaning composition according to claim 1, wherein the composition has a pH not in excess of 1.

5. The acidic hard surface cleaning composition according to claim 1, wherein the acid constituent consists of a ternary acid system comprising each of: sulfamic acid, formic acid and oxalic acid in a respective weight ratio of sulfamic acid: formic acid:oxalic acid of 1-8:1-5:1-3.

6. A method of providing a cleaning treatment of a hard surface which method comprises the step of: applying a cleaning effective amount of a composition according to claim 1, and optionally, thereafter wiping the treated hard surface to remove at least a part of the composition from the hard surface.

7. An acidic hard surface cleaning composition according to claim 1, wherein the second alcohol ethoxylate nonionic surfactant is a C10-C14 linear alcohol ethoxylated surfactant having at least about 8 mols ethoxylation.

8. An acidic hard surface cleaning composition according to claim 1, which comprises at least 90% wt. water.

* * * * *